US011654450B2

(12) United States Patent
Oda

(10) Patent No.: US 11,654,450 B2
(45) Date of Patent: May 23, 2023

(54) APPLICATION NEEDLE MEMBER, APPLICATION NEEDLE MEMBER ASSEMBLY, APPLICATION MEMBER, AND APPLICATION APPARATUS

(71) Applicant: NTN CORPORATION, Osaka (JP)

(72) Inventor: Atsushi Oda, Iwata (JP)

(73) Assignee: NTN CORPORATION, Osaka (JP)

( * ) Notice: Subject to any disclaimer, the term of this patent is extended or adjusted under 35 U.S.C. 154(b) by 0 days.

(21) Appl. No.: 17/265,159

(22) PCT Filed: Aug. 21, 2019

(86) PCT No.: PCT/JP2019/032628
§ 371 (c)(1),
(2) Date: Feb. 1, 2021

(87) PCT Pub. No.: WO2020/045187
PCT Pub. Date: Mar. 5, 2020

(65) Prior Publication Data

US 2021/0299694 A1 Sep. 30, 2021

(30) Foreign Application Priority Data

Aug. 31, 2018 (JP) ..... JP2018-162874

(51) Int. Cl.
*B05C 5/02* (2006.01)
*B05C 13/00* (2006.01)

(52) U.S. Cl.
CPC ..... *B05C 5/0208* (2013.01); *B05C 13/00* (2013.01)

(58) Field of Classification Search
CPC ..... B05C 5/0225
See application file for complete search history.

(56) References Cited

U.S. PATENT DOCUMENTS 5,598,973 A * 2/1997 Weston ..... B05B 12/085 239/583
5,934,520 A * 8/1999 Byerly ..... B05C 5/02 222/504

(Continued)

FOREIGN PATENT DOCUMENTS

CN 202590066 U 12/2012
CN 104668126 A 6/2015

(Continued)

OTHER PUBLICATIONS

International Search Report for PCT/JP2019/032628. Translated. (dated Year: 2019).*

(Continued)

*Primary Examiner* — Jethro M. Pence
(74) *Attorney, Agent, or Firm* — McDermott Will & Emery LLP

(57) ABSTRACT

An application needle member capable of eliminating contamination while suppressing reduction in working efficiency is an application needle member capable of applying a liquid material to an object. The application needle member comprises an application needle and an application needle insertion material. The application needle includes a tip facing the object and a bottom opposite to the tip. The application needle insertion material is attached to the bottom of the application needle. The application needle insertion material is configured to be detachably attachable to a fixing member.

4 Claims, 10 Drawing Sheets

(56) References Cited

U.S. PATENT DOCUMENTS

| | | | | |
|---|---|---|---|---|
| 6,715,506 | B1 * | 4/2004 | Ikushima | H01L 51/0004 137/14 |
| 2005/0045653 | A1 | 3/2005 | Tanaka et al. | |
| 2007/0219509 | A1 | 9/2007 | Tashiro et al. | |
| 2013/0095244 | A1 | 4/2013 | Maier et al. | |
| 2018/0071767 | A1 | 3/2018 | Belfance et al. | |
| 2019/0290856 | A1 | 9/2019 | Chevolleau et al. | |

FOREIGN PATENT DOCUMENTS

| | | | |
|---|---|---|---|
| CN | 105813765 | A | 7/2016 |
| CN | 107596503 | A | 1/2018 |
| EP | 0950378 | A | 10/1999 |
| JP | 2003-508888 | A | 3/2003 |
| JP | 2004-537685 | A | 12/2004 |
| JP | 2005-066391 | A | 3/2005 |
| JP | 2007-175584 | A | 7/2007 |
| JP | 2007-244671 | A | 9/2007 |
| JP | 2008-286370 | A | 11/2008 |
| JP | 2012-515121 | A | 7/2012 |
| JP | 2015-112577 | A | 6/2015 |
| WO | 01/17068 | A1 | 3/2001 |
| WO | 02/094707 | A1 | 11/2002 |
| WO | 2010/081174 | A2 | 7/2010 |

OTHER PUBLICATIONS

Written Opinion of the International Searching Authority for PCT/JP2019/032628. Translated. (dated Year: 2019).*

International Search Report issued: in corresponding International Patent Application No. PCT/JP2019/032628, dated Sep. 17, 2019, with English translation.

Japanese Office Action issued in corresponding Japanese Patent Application No. 2018-162874, dated Sep. 21, 2021, with English translation.

Japanese Office Action issued in corresponding Japanese Patent Application No. 2018-162874, dated Mar. 22, 2022, with English translation.

Chinese Office Action issued in corresponding Chinese Patent Application No. 201980056204.8, dated Apr. 11, 2022, with English translation.

Extended European Search Report issued in corresponding European Patent Application No. 19854623.6, dated Apr. 14, 2022.

* cited by examiner

APPLICATION NEEDLE MEMBER, APPLICATION NEEDLE MEMBER ASSEMBLY, APPLICATION MEMBER, AND APPLICATION APPARATUS

CROSS REFERENCE TO RELATED APPLICATIONS

This patent application is the U.S. National Phase under 35 U.S.C. § 371 of International Application No. PCT/JP2019/032628, filed on Aug. 21, 2019, which claims the benefit of Japanese Patent Application No. 2018-162874, dated Aug. 31, 2018, the entire contents of each are hereby incorporated by reference in their entirety.

TECHNICAL FIELD

The present invention relates to an application needle member, an application needle member assembly, an application member, and an application apparatus, and more specifically to an application needle member, an application needle member assembly, an application member, and an application apparatus capable of suppressing contamination in an operation of applying a material.

BACKGROUND ART

In recent years, electronic devices are multi-functioned, miniaturized and functionally advanced, and accordingly, quartz resonators and other similar electronic components and electrodes are increasingly miniaturized in size. Accordingly, when mounting an electronic component such as a quartz resonator, applying an electrically conductive liquid material finely and thickly is required. While fine patterns are formed generally in methods such as printing and ink-jetting, in addition thereto, a method using an application needle is also one option. The method using an application needle enables fine application using materials in a wide range of viscosity.

An application apparatus which applies a liquid material with an application needle is disclosed, for example, in Japanese Patent Laid-Open No. 2015-112577 (PTL 1). The application apparatus disclosed in Japanese Patent Laid-Open No. 2015-112577 includes an application mechanism supported by an XYZ stage. In the application mechanism, a movable portion and an application needle reciprocate in the direction Z as a cam operates. The application needle is immersed in a liquid material stored in an application material container, and thus has a surface with the liquid material adhering thereto. When the application needle reciprocates in the direction Z, the liquid material adhering to the surface of the application needle is applied to an object. According to Japanese Patent Laid-Open No. 2015-112577, an application needle fixing plate having the application needle bonded thereto is supported by a spring so as to be movable in one direction. This reduces or prevent damage caused to the tip of the application needle or the object as a high-speed operation is performed and the object is pressed in.

CITATION LIST

Patent Literature

PTL 1: Japanese Patent Laid-Open No. 2015-112577

SUMMARY OF INVENTION

Technical Problem

According to Japanese Patent Laid-Open No. 2015-112577, the application needle fixing plate and the application needle are integrally formed. That is, according to Japanese Patent Laid-Open No. 2015-112577, the application needle fixed to the application needle fixing plate cannot be replaced alone. Therefore, the application needle must be used to apply a liquid material of a type different from a liquid material previously applied with the same application needle. In this case, a liquid material of a type different from a liquid material to be applied may be introduced into the application needle, that is, contamination may arise.

In order to suppress such contamination, the application needle may have the liquid material manually wiped off in advance with a solvent such as acetone. The application needle may also be sterilized in advance with ethanol, an autoclave or the like. These methods, however, impair working efficiency.

The present invention has been made in view of the above issue. An object of the present invention is to provide an application needle member, an application needle member assembly, an application member, and an application apparatus capable of eliminating contamination while suppressing reduction in working efficiency.

Solution to Problem

According to the present disclosure, an application needle member is an application needle member capable of applying a liquid material to an object, and comprises an application needle and an application needle insertion material. The application needle includes a tip facing the object and a bottom opposite to the tip. The application needle insertion material is attached to the bottom of the application needle. The application needle insertion material is configured to be detachably attachable to a fixing member.

According to the present disclosure, an application needle member assembly comprises the application needle member and an application needle case. The application needle case is attached to the application needle member while accommodating the application needle therein.

According to the present disclosure, an application member comprises an application needle holder and a base body. The base body detachably holds the application needle holder. The application needle holder includes a main body portion and an application needle member. The application needle member is detachably attached to the main body portion.

According to the present disclosure, an application apparatus comprises the application member and a holding table. The holding table holds an object to which a liquid material is applied with the application needle member.

Advantageous Effects of Invention

Thus, when the type of liquid material to be applied is changed to another, the application needle member can be removed from the fixing member and replaced to prevent contamination while suppressing reduction in working efficiency.

DESCRIPTION OF EMBODIMENTS

Hereinafter, embodiments of the present invention will be described with reference to the drawings. In the figures, identical or equivalent components are identically denoted and will not be described redundantly.

First Embodiment

Figure 1:
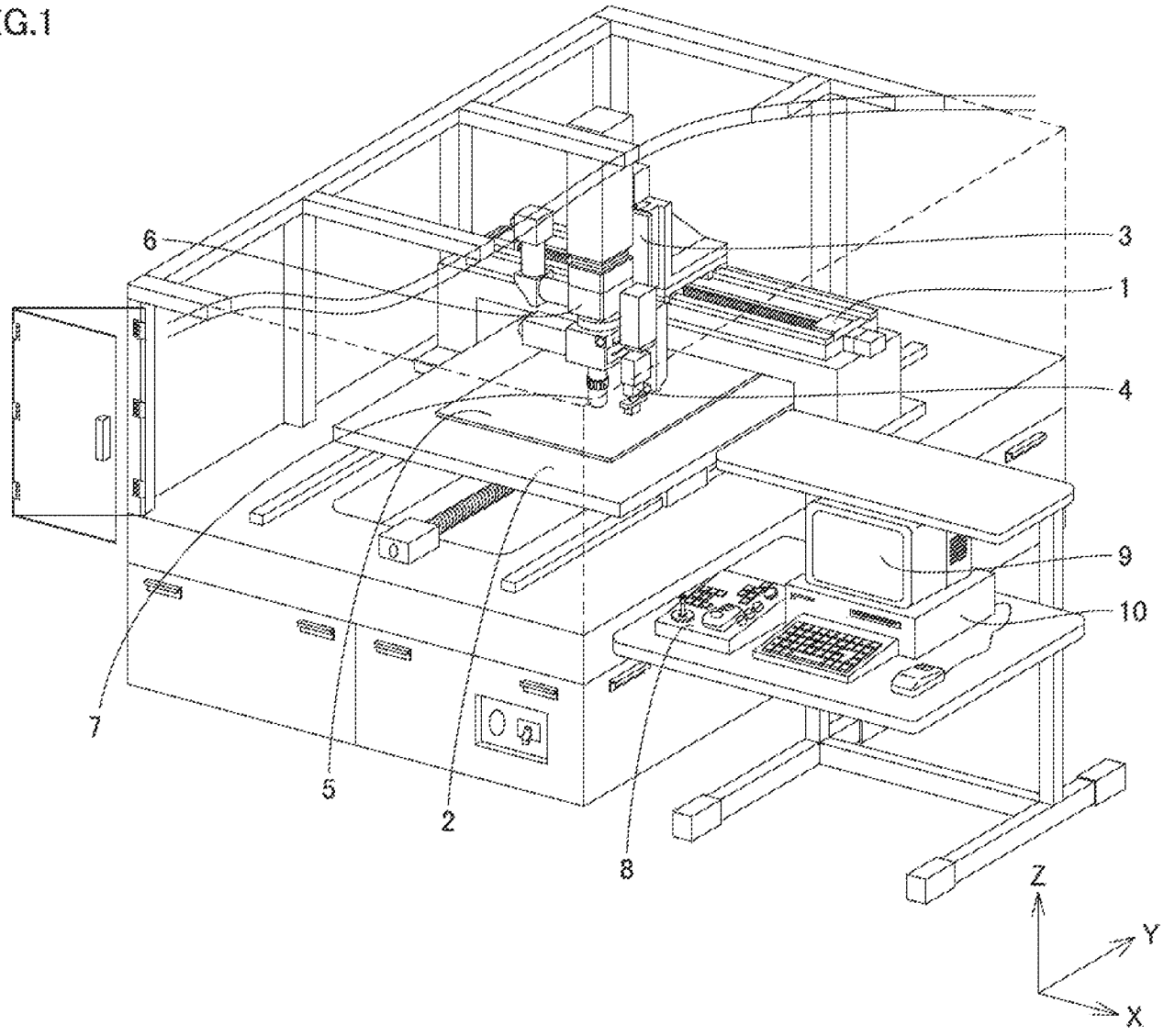
FIG. 1 schematically shows an application apparatus according to an embodiment.

FIG. 1 schematically shows an application apparatus according to the present embodiment. The application apparatus according to the present embodiment will be described with reference to FIG. 1. For the sake of convenience, directions X, Y and Z are introduced. Referring to FIG. 1, the application apparatus according to an embodiment of the present invention mainly comprises: a process chamber; a Y-axis table 2, an X-axis table 1, a Z-axis table 3, an application mechanism 4 as an application member, an observation optical system 6, and a CCD camera 7 connected to observation optical system 6, which are arranged inside the process chamber, and a control unit. The control unit includes a monitor 9, a control computer 10, and a console panel 8.

In the process chamber, Y-axis table 2 is placed above the floor of the process chamber. Y-axis table 2 is movable along the Y-axis. Specifically, a guide unit is placed on the lower surface of Y-axis table 2. The guide unit is slidably connected to a guide rail placed on the floor of the process chamber. A ball screw is connected to the lower surface of Y-axis table 2. The ball screw can be operated by a drive member such as a motor to cause Y-axis table 2 to move along the guide rail (along the Y-axis). Y-axis table 2 has an upper surface serving as a mount surface on which a substrate 5, which is an object to be processed, is mounted. Accordingly, Y-axis table 2 functions as a holding table to hold an object to which a liquid material is applied, or substrate 5.

X-axis table 1 is placed above Y-axis table 2. X-axis table 1 is disposed on a structure placed over and extending across Y-axis table 2 along the X-axis. X-axis table 1 is provided with a moving body to which Z-axis table 3 is connected, and the moving body is disposed to be movable along the X-axis. The moving body is movable along the X-axis by means of a ball screw for example. X-axis table 1 is fixed to the floor of the process chamber via the aforementioned structure. Therefore, Y-axis table 2 is movable along the Y-axis with respect to X-axis table 1.

On the moving body connected to X-axis table 1, Z-axis table 3 is placed as described above. To Z-axis table 3, observation optical system 6 and application mechanism 4 are connected. Observation optical system 6 is provided for observing an application position of substrate 5 to which a material is applied. CCD camera 7 converts an observed image into an electrical signal. Z-axis table 3 holds observation optical system 6 and application mechanism 4 so that they are movable along the Z-axis.

Control computer 10 and console panel 8 for controlling Y-axis table 2, X-axis table 1, Z-axis table 3, observation optical system 6, and application mechanism 4, as well as monitor 9 associated with control computer 10 are placed outside the process chamber. Monitor 9 displays image data converted by CCD camera 7, data output from control computer 10, and the like. Console panel 8 is used for entering instructions to control computer 10.

Figure 2:
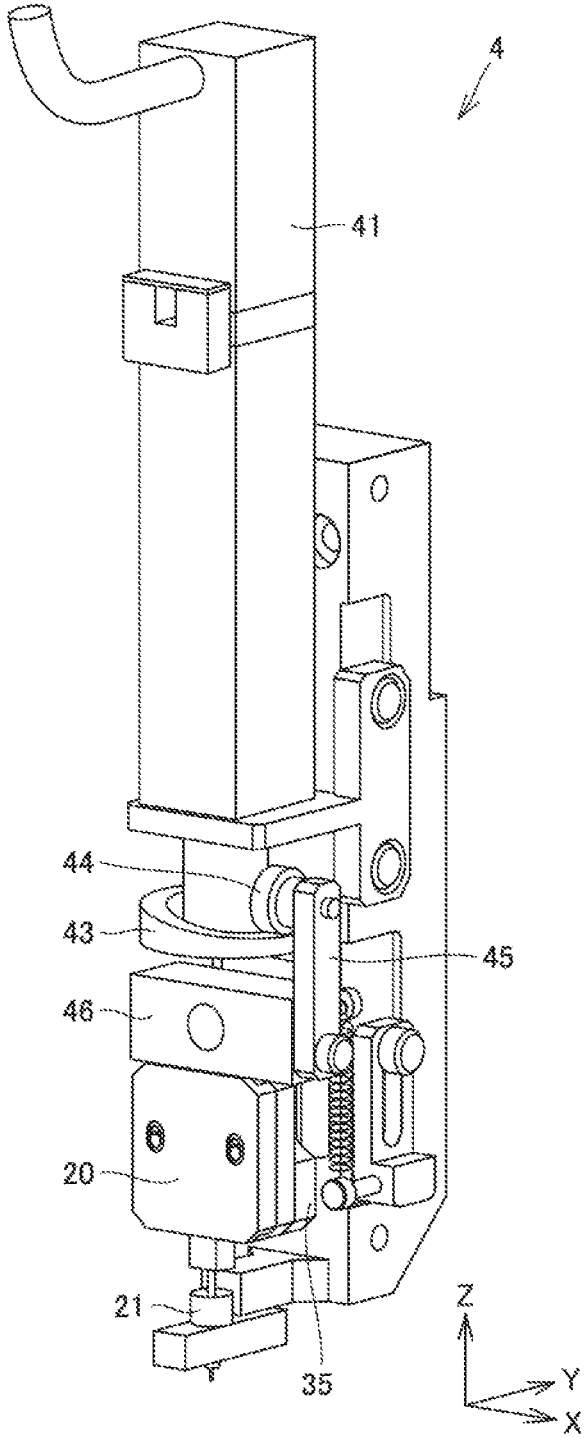
FIG. 2 schematically shows an application mechanism of the application apparatus shown in FIG. 1.

FIG. 2 schematically shows an application mechanism of the application apparatus shown in FIG. 1. Referring to FIG. 2, application mechanism 4 of the present embodiment mainly includes a servomotor 41, a cam 43, a bearing 44 held in contact with a cam surface of cam 43, a cam coupling plate 45, a movable portion 46, a movable base 35 holding an application needle holder 20, and an application material container 21. Application needle holder 20 is detachably attachable to movable base 35. In other words, movable base 35 as a base body detachably holds application needle holder 20.

In application mechanism 4, servo motor 41 is placed so that its central axis extends along the Z-axis shown in FIG. 1. Cam 43 is connected to a rotational shaft of servo motor 41. Cam 43 is rotatable about the central axis of servo motor 41. Cam 43 includes a central portion connected to the rotational shaft of servo motor 41, and a flange portion connected to one end of the central portion. The flange portion has an upper surface (a surface facing servomotor 41) serving as a cam surface. This cam surface is formed in an annular shape along the outer periphery of the central portion, and is formed to slope so that the distance from the bottom surface of the flange portion to the cam surface varies. Specifically, the cam surface includes: an upper-end flat region (having a large thickness) where the distance from the bottom surface is the largest distance; a lower-end flat region located at a distance from the upper-end flat region; and a slope portion smoothly connecting the upper-end flat region and the lower-end flat region together. The lower-end flat region is a region (having a small thickness) where the distance from the bottom surface is the smallest distance.

Bearing 44 is disposed to contact the cam surface of cam 43. Cam coupling plate 45 is connected to bearing 44. Cam coupling plate 45 has one end connected to bearing 44 and the other, opposite end fixed to movable portion 46. Movable base 35 as a base body is connected to movable portion 46. Application needle holder 20 is placed on movable base 35. Application needle holder 20 includes application needle 24. Application needle 24 can apply a liquid material to the object or substrate 5. Application needle 24 is disposed to protrude from the lower surface of application needle holder 20 (from the lower side opposite to the side where servomotor 41 is located). Under application needle holder 20, application material container 21 is disposed. Application needle 24 is inserted in application material container 21 and thus held.

A fixing pin is fixed to movable portion 46. Another fixing pin is fixed to a pedestal holding servo motor 41. A spring is placed to connect one fixing pin to the other fixing pin. On movable portion 46, a force in the direction toward application material container 21 is exerted by the spring. The force exerted by the spring causes bearing 44 to be kept pressed against the cam surface of cam 43.

Movable portion 46 and movable base 35 are connected to a linear guide placed on the pedestal that holds servo motor 41, and are movable along the Z-axis.

In application mechanism 4, servo motor 41 is driven to rotate the rotational shaft of servo motor 41 and thereby rotate cam 43. As a result, the position along Z-axis of bearing 44 that is in contact with the cam surface of cam 43 varies as the rotational shaft of servo motor 41 rotates. As bearing 44 positionally varies along the Z-axis, movable portion 46 and movable base 35 move along the Z-axis, and application needle 24 can thus be positionally changed along the Z-axis.

Figure 3:
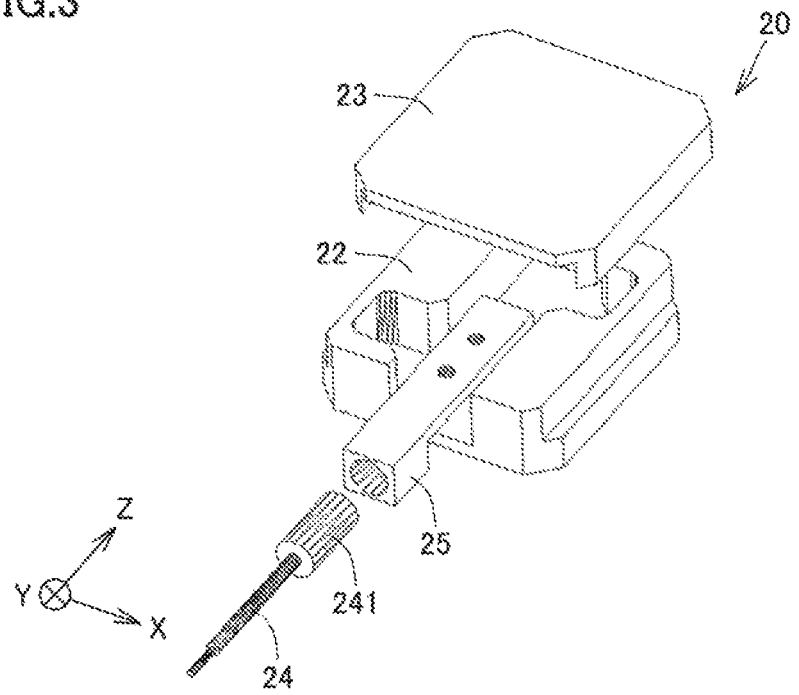
FIG. 3 schematically shows a configuration of an application needle holder shown in FIG. 2 according to a first embodiment.

FIG. 3 schematically shows a configuration of the application needle holder shown in FIG. 2 according to the first embodiment. In FIG. 3, for the sake convenience, each member included in the application needle holder is shown in an exploded manner. Referring to FIG. 3, application needle holder 20 mainly includes a holder base 22 and a holder lid 23 as a casing, and an application needle fixing plate 25 as a fixing member to which application needle 24 is fixed. Inside holder base 22, a recess is formed for accommodating application needle fixing plate 25 with application needle 24 connected thereto. In other words, application needle fixing plate 25 is disposed inside the casing composed of holder base 22 and holder lid 23. Application needle 24 has a tip by which a liquid material is applied to an object, and an end portion opposite to the tip in a direction in which application needle 24 extends (i.e., the direction Z shown in FIG. 3) (that is, an end portion on the side of the bottom of application needle 24), and application needle fixing plate 25 is fixed to the opposite end portion. Application needle fixing plate 25 detachably fixes application needle 24.

More specifically, an application needle insertion material 241 is attached to an end portion of application needle 24 located on a side opposite, as seen in the direction in which application needle 24 extends (i.e., the direction Z shown in FIG. 3), to a side where the liquid material is applied to the object (that is, on the side of the bottom of application needle 24). Application needle 24 and application needle insertion material 241 configure an application needle member. Application needle insertion material 241 is a cap-shaped member attached to the end portion of application needle 24 on the side of the bottom thereof. Application needle insertion material 241 is a member formed so as to externally cover a surface of the bottom of application needle 24. Application needle insertion material 241 is for example a cylindrical member. Application needle insertion material 241 has a hollow portion capable of accommodating a portion of the bottom of application needle 24. The hollow portion is preferably cylindrically shaped, for example, so as to be fittable to the external shape of application needle 24. The end portion of the bottom of application needle 24 is inserted into the hollow portion, for example. In this state, application needle insertion material 241 is attached to application needle 24. From a different point of view, the above-described application needle member is an application needle member capable of applying a liquid material to an object, and includes application needle 24 and application needle insertion material 241. Application needle 24 includes a tip facing the object and a bottom located opposite to the tip. Application needle insertion material 241 is attached to the bottom of application needle 24. As will be described hereinafter, application needle insertion material 241 is configured to be detachably attachable to application needle fixing plate 25 serving as a fixing member. Further, application mechanism 4 as an application member shown in FIG. 2 includes application needle holder 20 and movable base 35 serving as a base body. Movable base 35 detachably holds application needle holder 20. Application needle holder 20 includes: a main body portion including holder base 22, holder lid 23 and application needle fixing plate 25; and an application needle member including application needle 24 and application needle insertion material 241. Holder base 22 and holder lid 23 configure a casing. That is, the main body portion includes the casing and application needle fixing plate 25 serving as a fixing member. Application needle fixing plate 25 is disposed inside the casing. The application needle member including application needle 24 and application needle insertion material 241 is detachably attached to the main body portion. More specifically, application needle insertion material 241 is detachably attached to application needle fixing plate 25.

When application needle insertion material 241 is cut along a cross section intersecting a direction in which it extends (i.e., a cross section along the XY plane in FIG. 3), application needle insertion material 241 preferably has a cross-sectional area sufficiently larger than that of application needle 24. Application needle insertion material 241 has an outer diameter sufficiently larger than the diameter of application needle 24.

Application needle insertion material 241 configuring the application needle member is detachably attached to application needle fixing plate 25. That is, application needle insertion material 241 is disposed such that at least a portion thereof is embedded in an opening of application needle fixing plate 25. The opening is formed in an end portion of application needle fixing plate 25. In that state, application needle insertion material 241 is attached to application needle fixing plate 25. That is, application needle insertion material 241 and application needle fixing plate 25 are fixed together such that an inner circumferential surface of the opening of application needle fixing plate 25 is in contact with an external circumferential surface of application needle insertion material 241.

Figure 4:
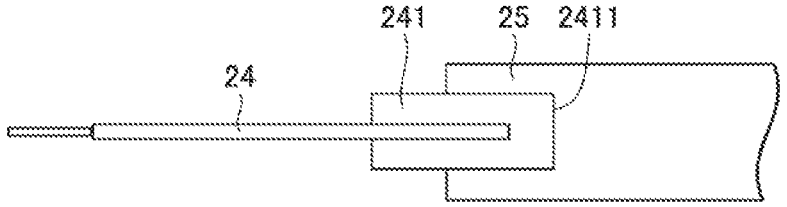
FIG. 4 is a schematic cross section of a first exemplary manner of attaching together an application needle, an application needle insertion material, and an application needle fixing plate shown in FIG. 3.
Figure 5:
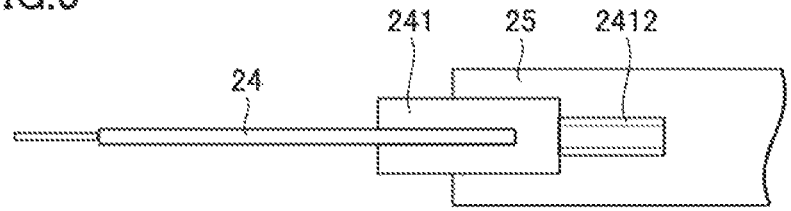
FIG. 5 is a schematic cross section of a second exemplary manner of attaching together the application needle, the application needle insertion material, and the application needle fixing plate shown in FIG. 3.

Specifically, application needle insertion material 241 is attached to application needle fixing plate 25 in the following manner. FIG. 4 is a schematic cross section of a first exemplary manner of attaching together the application needle, application needle insertion material, and application needle fixing plate shown in FIG. 3. Referring to FIG. 4, in the first example, application needle insertion material 241 and application needle fixing plate 25 are press-fitted so that, at an attachment portion 2411 that is an interface where the inner circumferential surface of the opening of application needle fixing plate 25 and the external circumferential surface of application needle insertion material 241 contact each other, the external circumferential surface of application needle insertion material 241 presses the inner circumferential surface of application needle fixing plate 25 and thus causes frictional resistance, which allows application needle insertion material 241 and application needle fixing plate 25 to be attached together. Application needle 24 is fixed such that application needle 24 has the bottom inserted into the opening formed in an end portion of application needle insertion material 241. Any method can be used to fix application needle 24 to application needle insertion material 241. FIG. 5 is a schematic cross section of a second exemplary manner of attaching together the application needle, application needle insertion material, and application needle fixing plate shown in FIG. 3. Referring to FIG. 5, in the second example, application needle insertion material 241 and application needle fixing plate 25 are attached together at a screw portion 2412 as a male screw and a female screw are screwed together. That is, application needle insertion material 241 shown in FIG. 5 has an extension composed of a male screw or a female screw which is formed at one end of application needle insertion material 241 opposite to the other end thereof having application needle 24 fixed thereto and configures screw portion 2412. A small opening that receives the extension is formed at the bottom surface of the opening of application needle fixing plate 25. A female screw or a male screw configuring screw portion 2412 is formed on the internal circumferential surface of the small opening.

Figure 6:
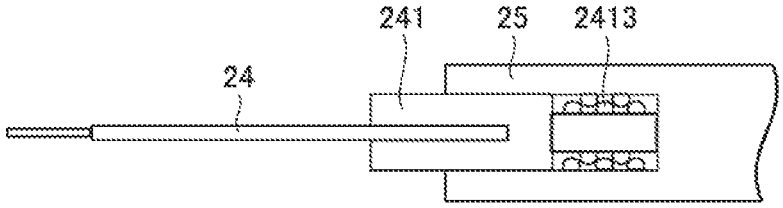
FIG. 6 is a schematic cross section of a third exemplary manner of attaching together the application needle, the application needle insertion material, and the application needle fixing plate shown in FIG. 3.

FIG. 6 is a schematic cross section of a third exemplary manner of attaching together the application needle, application needle insertion material, and application needle fixing plate shown in FIG. 3. Referring to FIG. 6, in the third example, application needle insertion material 241 and application needle fixing plate 25 are attached together at a luer portion 2413 by a so-called luer lock system. Luer portion 2413 is a groove-shaped portion provided on an external surface of application needle insertion material 241 and an internal surface of application needle fixing plate 25. Luer portion 2413 on the external surface of application needle insertion material 241 and luer portion 2413 formed on the internal circumferential surface of the opening of application needle fixing plate 25 interfere with each other to attach application needle insertion material 241 and application needle fixing plate 25 together. That is, application needle insertion material 241 shown in FIG. 6 has an extension having luer portion 2413 formed at one end of application needle insertion material 241 opposite to the other end thereof having application needle 24 fixed thereto. Luer portion 2413 is formed on the internal circumferential surface of the opening of application needle fixing plate 25 at a portion facing the extension.

Figure 7:
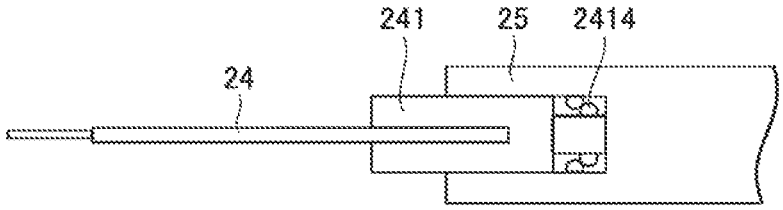
FIG. 7 is a schematic cross section of a fourth exemplary manner of attaching together the application needle, the application needle insertion material, and the application needle fixing plate shown in FIG. 3.

FIG. 7 is a schematic cross section of a fourth exemplary manner of attaching together the application needle, application needle insertion material, and application needle fixing plate shown in FIG. 3. Referring to FIG. 7, in the fourth example, application needle insertion material 241 and application needle fixing plate 25 are attached together at a latch portion 2414 by a so-called rotational latch system. Latch portion 2414 is a groove-shaped portion provided on an external surface of application needle insertion material 241 and an internal surface of application needle fixing plate 25. Latch portion 2414 on the external surface of application needle insertion material 241 and latch portion 2414 formed on the internal circumferential surface of the opening of application needle fixing plate 25 are relatively rotated about their rotation axis (i.e., a direction along the Z-axis in FIG. 3) and thus engaged together to attach application needle insertion material 241 and application needle fixing plate 25 together.

As shown in FIGS. 4 to 7, in the present embodiment, application needle insertion material 241 and application needle fixing plate 25 are attached together by any one selected from the group consisting of a press-fitting portion, a screw portion, a luer portion, and a latch portion.

In any of FIGS. 3 to 7, application needle insertion material 241 may be detachably attached to application needle 24. Note, however, that application needle insertion material 241 may be attached to application needle 24 so as to be fixed thereto undetachably. When application needle insertion material 241 is fixed to application needle 24 undetachably, application needle 24 can be easily detached from fixing plate 25 by detaching application needle insertion material 241 from fixing plate 25. When application needle insertion material 241 is detachably attached to application needle 24, it is done so preferably by press fitting, for example. When application needle insertion material 241 is fixed to application needle 24 undetachably, it is preferably done so with an adhesive for example.

Application needle insertion material 241 is preferably formed of a material different from that of application needle 24. Specifically, for example, application needle 24 is preferably formed of a generally known stainless steel material. Application needle insertion material 241 is preferably formed for example of generally known polyethylene resin, polypropylene resin, or other resin materials.

Figure 8:
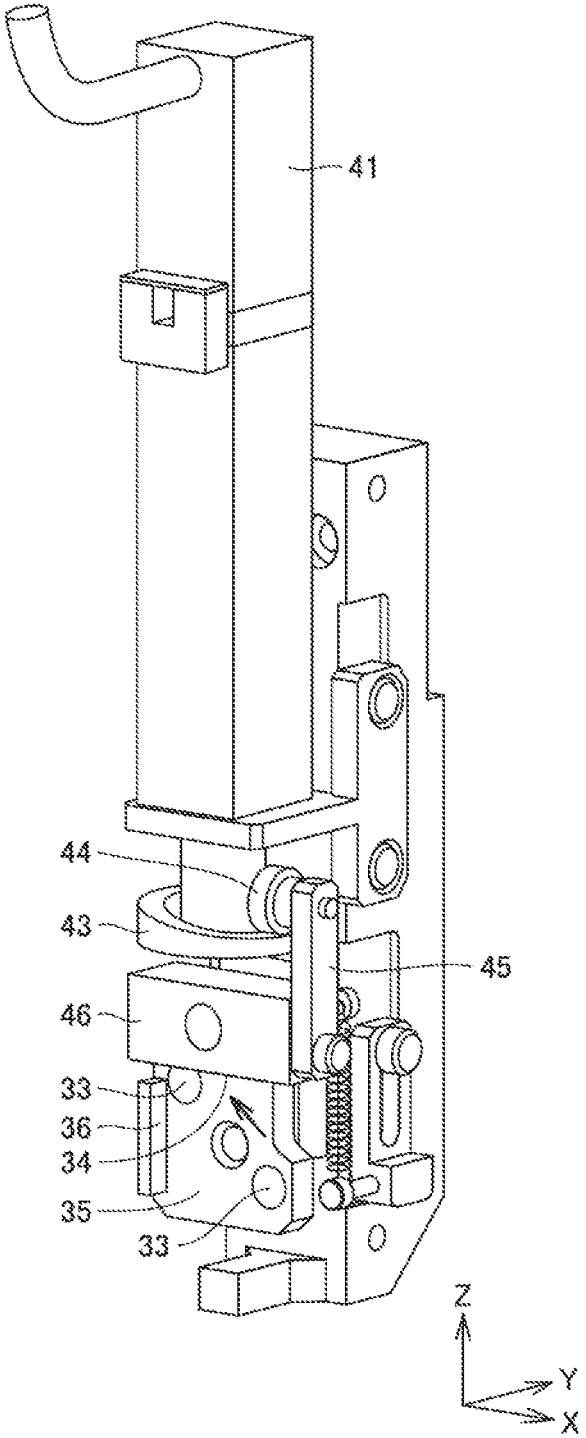
FIG. 8 schematically shows a base body of the application mechanism shown in FIG. 2.

FIG. 8 schematically shows the base body in the application mechanism shown in FIG. 2. Referring to FIG. 8, as has been described above, in application mechanism 4, application needle holder 20 is detachably attachable to movable base 35. Specifically, a plurality of (e.g., two) magnets are disposed on a surface of application needle holder 20 that is to face movable base 35 (i.e., a surface of holder base 22), although not shown. Further, as shown in FIG. 8, a plurality of magnets 33 (two magnets in FIG. 8) are also disposed on movable base 35. The magnets on the surface of holder base 22 and magnets 33 of movable base 35 shown in FIG. 8 attract each other to enable application needle holder 20 to be placed on movable base 35. Positionally adjusting the magnets on the surface of holder base 22 and magnets 33 of movable base 35 allows application needle holder 20 to be accurately positioned when application needle holder 20 is attracted to movable base 35 by a magnetic force acting between the magnets of holder base 22 and magnets 33 of movable base 35.

Figure 9:
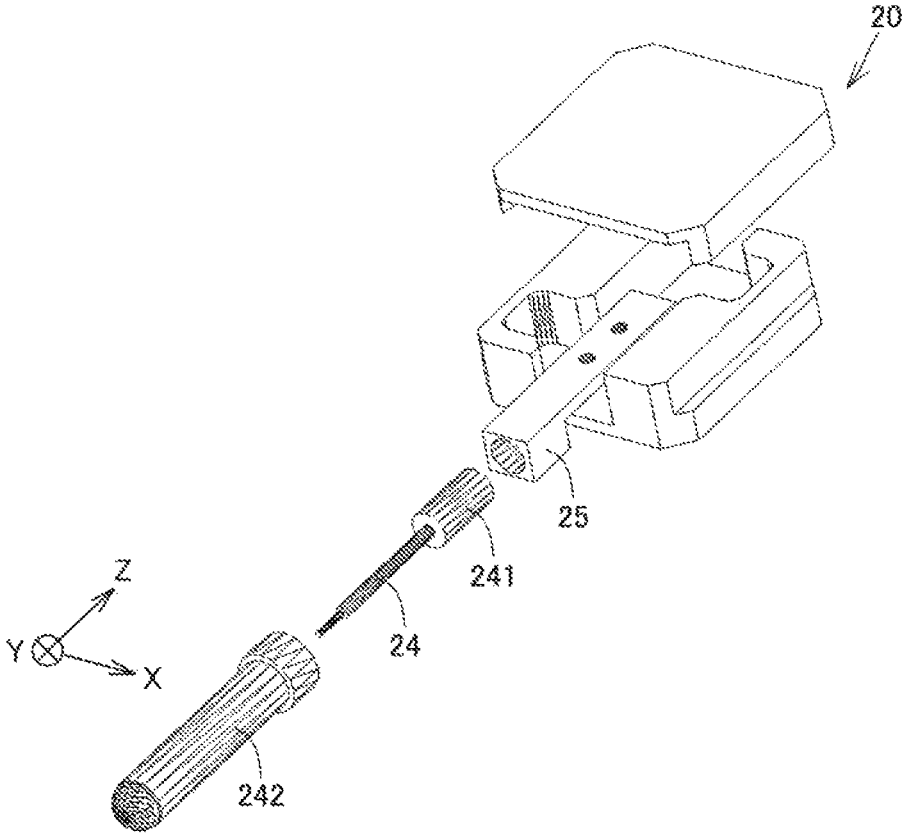
FIG. 9 is a schematic diagram also showing an application needle case to be attached to the application needle of the application needle holder of FIG. 3.

For example, a reference surface of application needle holder 20 in the direction Z can be pressed against a reference surface 34 of movable base 35, and a reference surface of application needle holder 20 in the direction X can be pressed against a reference surface 36 of movable base 35. Such a state can be implemented for example by the following configuration: That is, a magnet of application needle holder 20 and a magnet of movable base 35 that face each other when application needle holder 20 is placed on movable base 35 have their relative positions adjusted. Specifically, magnets 33 of movable base 35 are set to be positionally closer to reference surfaces 34 and 36 than the magnets of application needle holder 20. This allows a magnetic force between the magnets on the surface of application needle holder 20 and magnets 33 of movable base 35 to exert a force to attract application needle holder 20 toward reference surfaces 34 and 36 (i.e., in a direction indicated in FIG. 8 by an arrow). As a result, application needle holder 20 can be fixed to movable base 35 with good reproducibility with high positional accuracy. FIG. 9 is a schematic diagram also showing an application needle case to be attached to application needle 24 of the application needle holder shown in FIG. 3. In FIG. 9, for the sake of convenience, each member included in the application needle holder is shown in an exploded manner. Referring to FIG. 9, application needle holder 20 includes an application needle case 242 in addition to the members shown in FIG. 3. Application needle case 242 is a cap-shaped member that covers application needle 24 and has an end portion attached to application needle insertion material 241.

Application needle case 242 is a member formed so as to externally cover a surface of a portion of application needle 24 excluding a portion thereof covered with application needle insertion material 241. Application needle case 242 has, for example, a cylindrical shape extending in the direction in which application needle 24 extends. An end portion of application needle case 242 that is located on the side of the tip of application needle 24 is curved. Note, however, that application needle case 242 may have a shape close to a cone having a diameter reduced toward the tip of application needle 24. In any case, application needle case 242 can partially or entirely accommodate application needle 24.

When application needle case 242 is cut along a cross section intersecting the direction in which it extends (i.e., a cross section along the XY plane in FIG. 3), application needle case 242 preferably has an internal space accommodating application needle 24 with a cross-sectional area sufficiently larger than that of application needle 24. For example, the internal space accommodating application needle 24 preferably has a width three times or more the diameter of application needle 24. Application needle case 242 has an external shape sufficiently larger in thickness than application needle 24.

Figure 10:
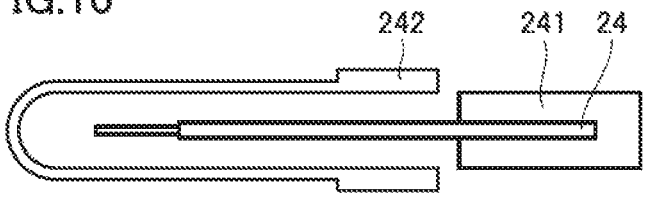
FIG. 10 is a schematic cross section of a first exemplary state before the application needle case is attached to the application needle member in the present embodiment.
Figure 11:
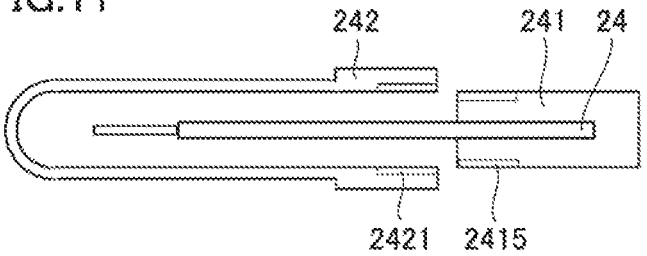
FIG. 11 is a schematic cross section of a second exemplary state before the application needle case is attached to the application needle member in the present embodiment.
Figure 12:
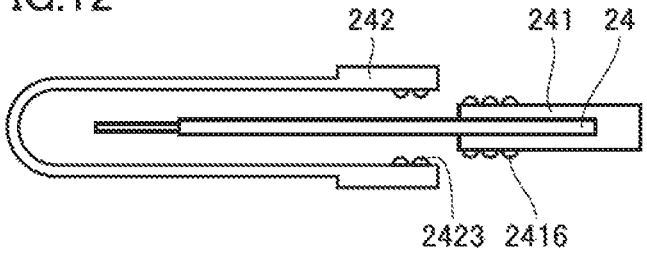
FIG. 12 is a schematic cross section of a third exemplary state before the application needle case is attached to the application needle member in the present embodiment.
Figure 13:
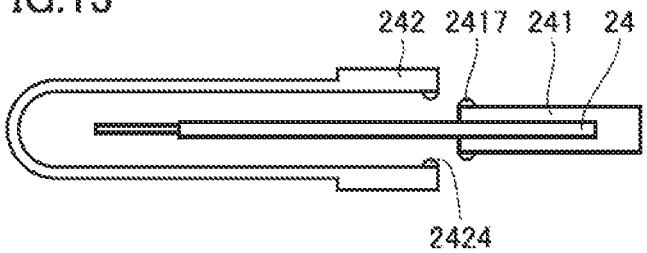
FIG. 13 is a schematic cross section of a fourth exemplary state before the application needle case is attached to the application needle member in the present embodiment.

Application needle case 242 is detachably attachable to application needle 24. More specifically, application needle case 242 is detachably attachable to the application needle member composed of application needle 24 and application needle insertion material 241. FIG. 10 is a schematic cross section of a first exemplary state before the application needle case is attached to the application needle member in the present embodiment. FIG. 11 is a schematic cross section of a second exemplary state before the application needle case is attached to the application needle member in the present embodiment. FIG. 12 is a schematic cross section of a third exemplary state before the application needle case is attached to the application needle member in the present embodiment. FIG. 13 is a schematic cross section of a fourth exemplary state before the application needle case is attached to the application needle member in the present embodiment. Referring to FIG. 10, as shown in the first example, the state before application needle case 242 is attached to the application needle member composed of application needle 24 and application needle insertion material 241 is as follows: That is, when application needle case 242 is attached to the application needle member, application needle case 242 covers application needle 24 from the side of the tip of application needle 24 opposite to the bottom thereof attached to application needle insertion material 241. Referring to FIGS. 11, 12 and 13, the second, third and fourth examples are basically similar to FIG. 10. In the first example shown in FIG. 10, application needle case 242 has an open end portion brought into contact with and thus fixed to an external circumferential surface of application needle insertion material 241, as will be described hereinafter. Application needle case 242 has the open end portion with a smooth inner circumferential surface and application needle insertion material 241 has a smooth external circumferential surface.

In FIG. 11, a screw portion 2415 is formed on a surface of application needle insertion material 241 at a portion accommodated in application needle case 242. Further, in FIG. 11, a screw portion 2421 is formed on the inner circumferential surface of application needle case 242 at a region on the side of the open end portion. One of screw portion 2415 and screw portion 2421 is a male screw, and the other is a female screw.

In FIG. 12, a lure portion 2416 is formed on a surface of application needle insertion material 241 at a portion accommodated in application needle case 242. Further, in FIG. 12, a lure portion 2423 is formed on the inner circumferential surface of application needle case 242 at a region on the side of the open end portion.

In FIG. 13, a latch portion 2417 is formed on a surface of application needle insertion material 241 at a portion accommodated in application needle case 242. Further, in FIG. 12, a latch portion 2424 is formed on the inner circumferential surface of application needle case 242 at a region on the side of the open end portion.

Figure 14:
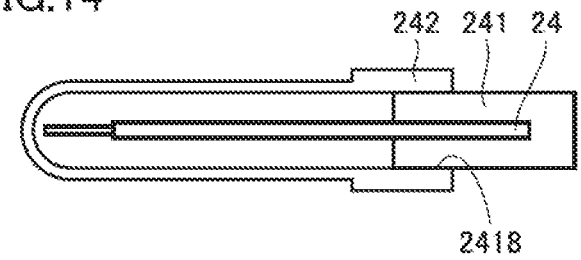
FIG. 14 is a schematic cross section of a first exemplary manner of attaching the FIG. 10 application needle member and application needle case together.
Figure 15:
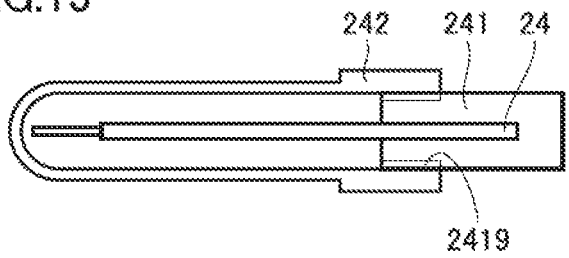
FIG. 15 is a schematic cross section of a second exemplary manner of attaching the FIG. 11 application needle member and application needle case together.
Figure 16:
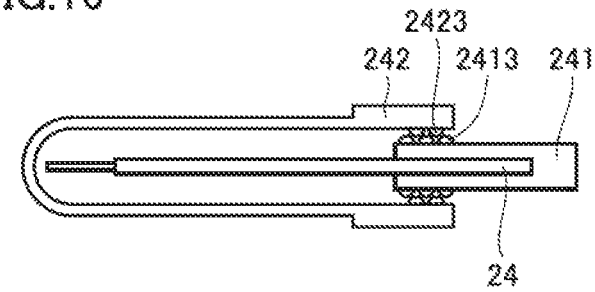
FIG. 16 is a schematic cross section of a third exemplary manner of attaching the FIG. 12 application needle member and application needle case together.
Figure 17:
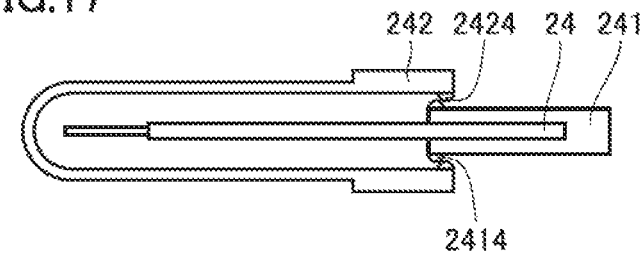
FIG. 17 is a schematic cross section of a fourth exemplary manner of attaching the FIG. 13 application needle member and application needle case together.

FIG. 14 is a schematic cross section of a first exemplary manner of attaching the FIG. 10 application needle member and application needle case together. FIG. 15 is a schematic cross section of a second exemplary manner of attaching the FIG. 11 application needle member and application needle case together. FIG. 16 is a schematic cross section of a third exemplary manner of attaching the FIG. 12 application needle member and application needle case together. FIG. 17 is a schematic cross section of a fourth exemplary manner of attaching the FIG. 13 application needle member and application needle case together. Referring to FIGS. 14 to 17, application needle case 242 of each of FIGS. 10 to 13 is attached to application needle insertion material 241 configuring an application needle member, as shown in FIGS. 14 to 17. FIGS. 14 to 17 show a structure in which an application needle member and application needle case 242, which serve as an application needle member assembly, are attached together. Application needle case 242 is attached to the application needle member while accommodating application needle 24 of the application needle member therein. Specifically, referring to FIG. 14, in the first example, application needle case 242 and application needle 24 are attached together at an attachment portion 2418 by press fitting. An end portion of application needle insertion material 241 on the side of application needle 24 is press-fitted into the open end portion of application needle case 242. The inner circumferential surface of the open end portion of application needle case 242 and the external circumferential surface of application needle insertion material 241 at the end portion thereof on the side of application needle 24 are in contact with each other. A frictional force is generated at a press-fitting portion that is an interface where the inner circumferential surface of the open end portion of application needle case 242 and the external circumferential surface of application needle insertion material 241 at the end portion thereof on the side of application needle 24 contact each other.

Referring to FIG. 15, in the second example, application needle case 242 and application needle insertion material 241 are attached together at a screw portion 2419 formed by screwing the FIG. 11 screw portion 2415 into the FIG. 11 screw portion 2421.

Referring to FIG. 16, in the third example, application needle case 242 and application needle insertion material 241 are attached together in a so-called luer lock system as the FIG. 12 luer portion 2416 and luer portion 2423 mesh with each other. This manner is similar to luer portion 2413 shown in FIG. 6. That is, in FIG. 6, a portion corresponding to luer portion 2416 in FIG. 12 and a portion corresponding to luer portion 2423 in FIG. 12 are collectively shown as luer portion 2413.

Referring to FIG. 17, in the fourth example, application needle case 242 and application needle insertion material 241 are attached together in a so-called rotational latch system as latch portions 2417 and 2424 shown in FIG. 13 mesh with each other. This manner is similar to latch portion 2414 shown in FIG. 7. That is, in FIG. 7, a portion corresponding to latch portion 2417 in FIG. 13 and a portion corresponding to latch portion 2424 in FIG. 13 are collectively shown as latch portion 2414.

As shown in FIGS. 14 to 17, in the present embodiment, application needle insertion material 241 is configured such that application needle case 242 accommodating application needle 24 therein is attached thereto. Application needle insertion material 241 and application needle case 242 are attached together by any one selected from the group consisting of a press-fitting portion, a screw portion, a luer portion, and a latch portion. Further, as shown in FIGS. 4 to 7 and 10 to 17, application needle insertion material 241 includes a first attachment portion (attachment portion 2411 of FIG. 4, screw portion 2412 of FIG. 5, luer portion 2413 of FIG. 6, and latch portion 2414 of FIG. 7) allowing application needle insertion material 241 to be detachably attached to application needle fixing plate 25 serving as a fixing member, and a second attachment portion (attachment portion 2418 of FIG. 14, screw portion 2419 of FIG. 15, luer portion 2413 of FIG. 16, and latch portion 2414 of FIG. 17) allowing application needle case 242 to be attached to application needle insertion material 241. This ensures attachment between application needle insertion material 241 and another member.

In the states shown in FIGS. 14 to 17, the application needle member composed of application needle 24 and application needle insertion material 241 with application needle case 242 attached thereto may be sterilized. For example, the application needle member is sterilized when it is used for a medical purpose or in a biochemical experiment, in particular. In that case, the sterilizing operation is performed using EOG (ethylene oxide gas), gamma rays, electron beams, or the like. Specifically, initially, the application needle member with application needle case 242 attached thereto is individually packaged. In this state, EOG is introduced into the individual package, and the individual package is sealed. Alternatively, the individually packaged application needle member with application needle case 242 attached thereto is exposed to gamma rays or electron beams. In the case of sterilization with EOG, the individual package may partially or entirely be composed of a member such as film or fiber which is permeable to a sterilizing gas such as EOG. In order to allow the sterilizing gas to come into contact with application needle 24 located inside application needle case 242, it is preferable that application needle case 242 is previously provided with a hole for permeation of gas.

Normally, the application needle member composed of application needle 24 and application needle insertion material 241 is sold with application needle case 242 attached to cover application needle 24, as shown in FIGS. 14 to 17. The application needle member sold in this state is attached to application needle fixing plate 25 at a customer's end. The attachment is done in a manner shown in any one of FIGS. 4 to 7. The application needle member attached to application needle fixing plate 25 is used with application needle case 242 removed therefrom.

The present embodiment has a function and effect, as described hereinafter. An application needle member comprising application needle 24 and application needle insertion material 241 according to the present embodiment is fixed to application needle fixing plate 25 of application needle holder 20. In other words, application needle fixing plate 25 is disposed in application needle holder 20 inside a casing composed of holder base 22 and holder lid 23 according to the present embodiment. Application needle 24 is detachably attached to application needle fixing plate 25. That is, the application needle member including application needle 24 can be removed from application needle fixing plate 25 and replaced as desired. Therefore, for example, when a plurality of different types of liquid materials are applied, the application needle member can be easily replaced for each liquid material. Therefore, it is no longer necessary to apply a plurality of types of liquid materials by using the same application needle 24. This can suppress contamination caused when a liquid material to be applied is mixed with another type of liquid material as a plurality of types of liquid materials are applied using the same application needle 24. Further, a cleaning operation of manually wiping a liquid material off application needle 24 with a solvent such as acetone in advance can be dispensed with. This can improve the efficiency of an operation of application using application needle 24.

Note that application needle insertion material 241 is attached to application needle 24, and application needle insertion material 241 is detachably attached to application needle fixing plate 25. Application needle insertion material 241 and application needle fixing plate 25 are attached together by any one selected from the group consisting of attachment portion 2411 (see FIG. 4) that is a press fitting portion attached by press fitting, screw portion 2412 (see FIG. 5), luer portion 2413 (see FIG. 6), and latch portion 2414 (see FIG. 7). Therefore, application needle 24 can be easily removed from application needle fixing plate 25 and thus replaced.

In the present embodiment, application needle case 242 can be attached to the application needle member so as to cover application needle 24. Herein, application needle case 242 is attached to application needle insertion material 241 configuring the application needle member. Application needle insertion material 241 and application needle case 242 are attached together by any one selected from the group consisting of attachment portion 2418 that is a press fitting portion (see FIG. 14), screw portion 2419 (see FIG. 15), luer portions 2416 and 2423 (see FIGS. 12 and 16), and latch portions 2417 and 2424 (see FIGS. 13 and 17). In replacing an application needle member including application needle 24 with another application needle member including application needle 24, contamination caused as a foreign matter adheres to a surface of application needle 24 of the other application needle member can be suppressed. In addition, the application needle member can be replaced in a state in which application needle 24 is protected by application needle case 242. This can suppress an accident in which an operator accidentally pricks his/her hand or the like with the tip of application needle 24 when the operator replaces the application needle member with another.

Second Embodiment

Figure 18:
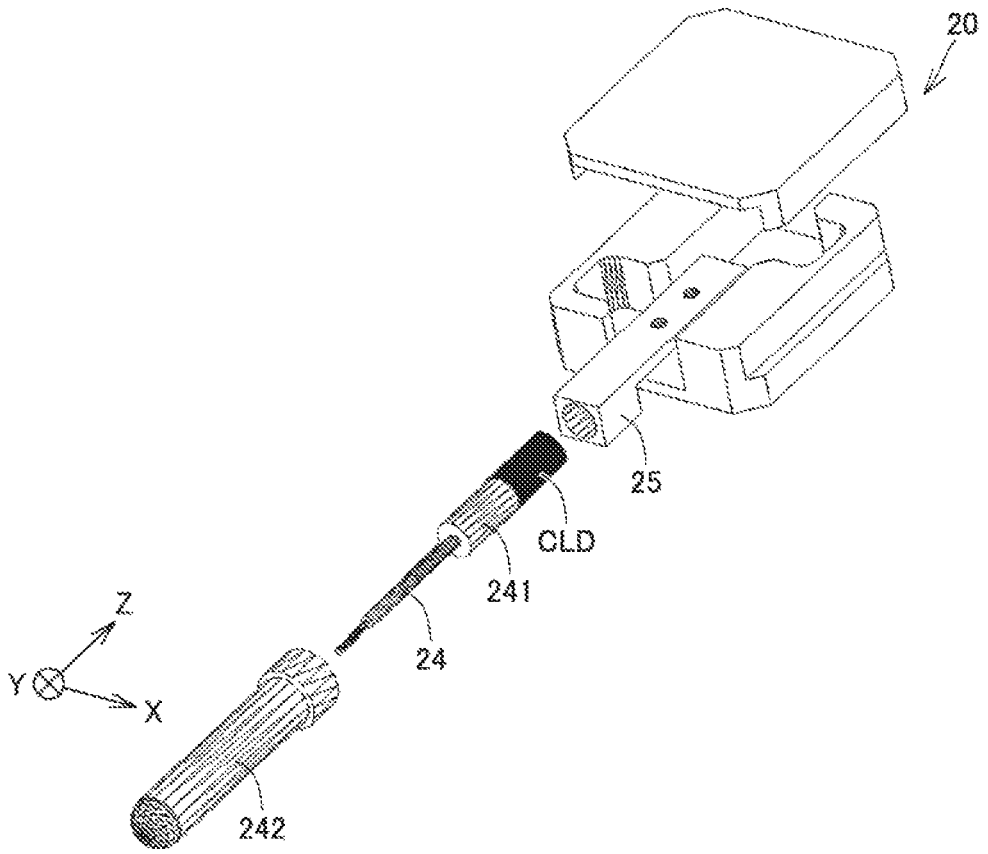
FIG. 18 schematically shows a configuration of an application needle holder according to a second embodiment.
Figure 19:
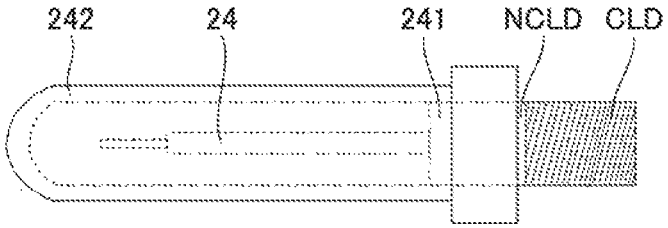
FIG. 19 is a schematic cross section of a manner of attaching together an application needle member and an application needle case shown in FIG. 18.

FIG. 18 schematically shows a configuration of an application needle holder according to a second embodiment. FIG. 19 schematically shows how the application needle member and the application needle case shown in FIG. 18 are attached together. In contrast to the schematic cross sections of FIGS. 14 to 17, FIG. 19 shows application needle case 242 with its interior indicated by a dotted line as if it were seen through.

Referring to FIGS. 18 and 19, application needle holder 20 according to the present embodiment has basically the same configuration as that of application needle holder 20 according to the first embodiment. Application needle insertion material 241 detachably attached to application needle fixing plate 25 and application needle case 242 attached to application needle insertion material 241 are also basically the same in configuration as those in the first embodiment. Accordingly, identical components are identically denoted and any feature shared with the first embodiment will not be described repeatedly.

Note, however, that, as shown in FIGS. 18 and 19, in the present embodiment, application needle insertion material 241 has at least a portion having a surface colored to provide a colored portion CLD. In this regard, the present embodiment is different in configuration from the first embodiment, which does not include such a colored portion CLD. The region of application needle insertion material 241 in which colored portion CLD is provided is a region to be inserted into the opening of application needle fixing plate 25 and fixed therein. Colored portion CLD is provided to application needle insertion material 241 on a surface of a region on a side opposite, as seen in a direction in which application needle 24 extends, to a side where a liquid material is applied, i.e., on a surface of a region on the side of the bottom of application needle 24. In FIG. 19, a region of the surface of application needle insertion material 241 other than colored portion CLD is a non-colored portion NCLD. Colored portion CLD may have any color that is different from that of non-colored portion NCLD. Colored portion CLD may be a colored resin layer coating a surface of application needle insertion material 241, or may be formed by winding a colored resin tape on application needle insertion material 241.

The present embodiment has a function and effect, as described hereinafter. The present embodiment has a function and effect similar to those of the first embodiment and the following function and effect:

In the present embodiment, application needle insertion material 241 has at least a portion provided with colored portion CLD, as has been described above. That is, colored portion CLD is provided to application needle insertion material 241 on a surface of a region relatively close to application needle fixing plate 25. Therefore, application needle insertion material 241 is disposed such that a portion thereof including colored portion CLD, in particular, is embedded in the opening of application needle fixing plate 25. For example, colored portion CLD is attached through a press-fitting step to application needle fixing plate 25 at attachment portion 2411 as shown in FIG. 4. As a result, the user of application needle holder 20 can push application needle insertion material 241 into the opening of application needle fixing plate 25 so that application needle insertion material 241 has colored portion CLD entirely inserted into the opening of application needle fixing plate 25 to ensure that application needle insertion material 241 is fixed to application needle fixing plate 25.

Third Embodiment

Figure 20:
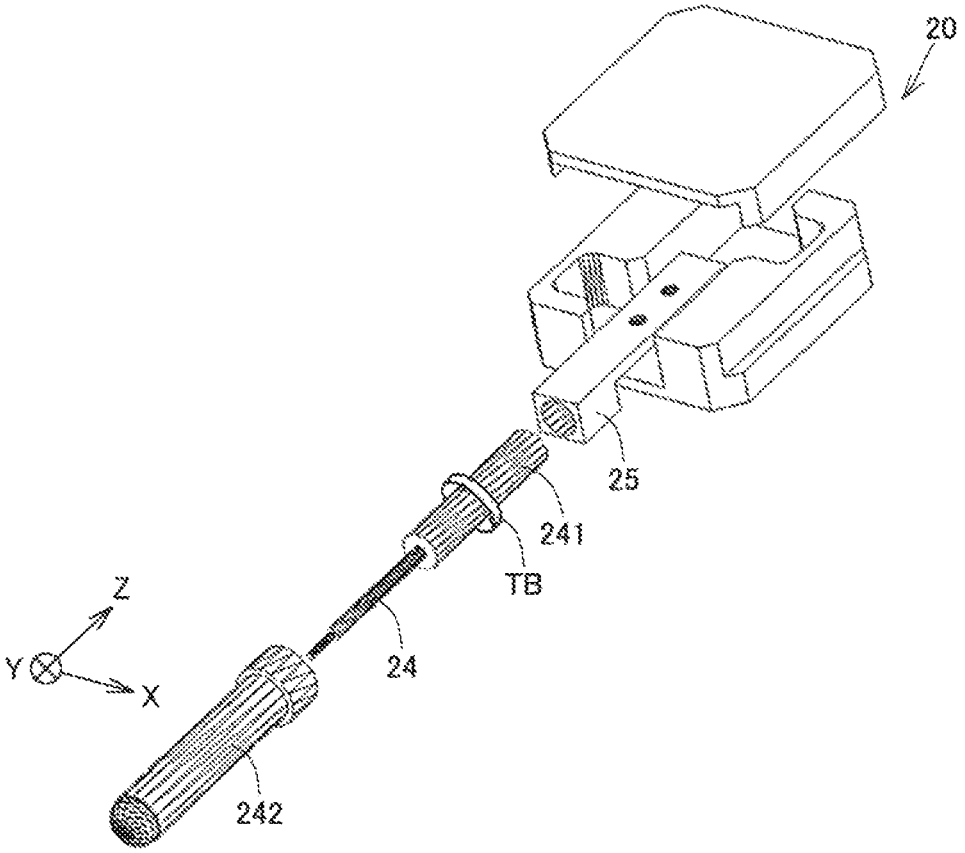
FIG. 20 schematically shows a configuration of an application needle holder according to a third embodiment.
Figure 21:
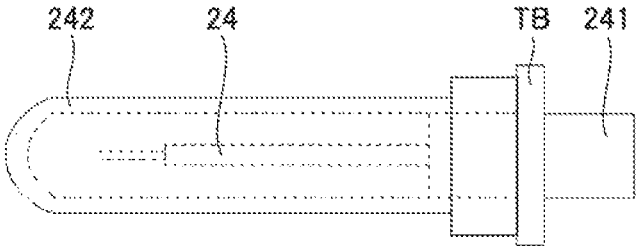
FIG. 21 is a schematic cross section of a manner of attaching together an application needle member and an application needle case shown in FIG. 20.

FIG. 20 schematically shows a configuration of an application needle holder according to a third embodiment. FIG. 21 schematically shows how the application needle member and the application needle case in FIG. 20 are attached together. As well as FIG. 19, FIG. 21 shows application needle case 242 with its interior indicated by a dotted line as if it were seen through.

Referring to FIGS. 20 and 21, application needle holder 20 according to the present embodiment has basically the same configuration as that of application needle holder 20 according to the first embodiment. Application needle insertion material 241 detachably attached to application needle fixing plate 25 and application needle case 242 attached to application needle insertion material 241 are also basically the same in configuration as those in the first embodiment. Accordingly, identical components are identically denoted and any feature shared with the first embodiment will not be described repeatedly.

It should be noted, however, that, as shown in FIGS. 20 and 21, in the present embodiment, application needle insertion material 241 has a portion provided with a flange portion TB that is larger in a size, that is, a diameter for example, (in the XY plane) intersecting a direction in which application needle insertion material 241 extends (i.e., the direction Z) than the remainder of application needle insertion material 241. In this regard, the present embodiment is different in configuration from the first and second embodiments that do not have such a flange portion TB.

Flange portion TB has a diameter (or a distance from its center) in cross section preferably 1.5 times or more and 2 times or less, more preferably 1.6 times or more and 1.9 times or less, that in cross section of a region of application needle insertion material 241 excluding flange portion TB. Flange portion TB at least has only to have a maximum width larger than that of the opening of application needle fixing plate 25. The maximum width of flange portion TB may be larger or smaller than a size (a length of one side, or a diameter) of application needle fixing plate 25 in the XY plane.

Flange portion TB may be disposed at a position including a central portion of application needle insertion material 241 in the direction in which application needle insertion material 241 extends (or the direction Z in FIG. 20). Note, however, that this is not exclusive, and flange portion TB may be formed for example to be disposed in a region closer to the tip of application needle 24 than the central portion of application needle insertion material 241 in the direction in which application needle insertion material 241 extends.

The present embodiment has a function and effect, as described hereinafter. The present embodiment has a function and effect similar to those of the first embodiment and the following function and effect:

In the present embodiment, application needle insertion material 241 has at least a portion provided with flange portion TB, as has been described above. Accordingly, for example, application needle insertion material 241 can be attached to application needle fixing plate 25 such that a region of application needle insertion material 241 opposite, as seen at flange portion TB, to an end portion of application needle insertion material 241 having application needle 24 connected thereto is entirely accommodated in the opening of application needle fixing plate 25. That is, flange portion TB functions as a stopper when application needle insertion material 241 is fixed to application needle fixing plate 25. When presence of flange portion TB is compared with absence thereof, the former can suppress variation in length along the Z-axis of a region of application needle insertion material 241 inserted into the opening of application needle fixing plate 25.

Note that the features of the above-described embodiments (or examples) may be combined as appropriate within a consistent range in the art. For example, the third embodiment may also be provided with colored portion CLD on a surface of application needle insertion material 241 on a side opposite to the tip of application needle 24, as seen at flange portion TB. As well as the first embodiment, the second and third embodiments have only to attach application needle insertion material 241 and application needle fixing plate 25 together by any one selected from the group consisting of a press-fitting portion, a screw portion, a luer portion, and a latch portion. Further, as well as the first embodiment, the second and third embodiments have only to attach application needle insertion material 241 and application needle case 242 together by any one selected from the group consisting of a press-fitting portion, a screw portion, a luer portion, and a latch portion.

The embodiments disclosed herein should be considered as illustrative in any respect and not restrictive. The scope of the present invention is defined by the terms of the claims, rather than the above description, and is intended to include any modifications within the meaning and scope equivalent to the terms of the claims.

REFERENCE SIGNS LIST

1 X-axis table, 2 Y-axis table, 3 Z-axis table, 4 application mechanism, 5 substrate, 6 observation optical system, 7 CCD camera, 8 console panel, 9 monitor, 10 control computer, 20 application needle holder, 21 application material container, 22 holder base, 23 holder lid, 24 application needle. 25 application needle fixing plate, 33 magnet, 34, 36 reference surface, 35 movable base, 41 servomotor, 43 cam, 44 bearing, 45 cam coupling plate, 46 movable portion, 241 application needle insertion material, 242 application needle case, 2411 attachment portion, 2412, 2415, 2419, 2421 screw portion, 2413, 2416, 2423 luer portion, 2414, 2417, 2424 latch portion, CLD colored portion, NCLD non-colored portion.

The invention claimed is:

1. An application needle member capable of applying a liquid material to an object, comprising:

an application needle including a first end and a second end opposite the first end, the first end being a tip of the application needle facing the object, wherein the application needle as a whole is made of a single member;

an application needle insertion material having a recess that accommodates and covers an entirety of the second end of the application needle; and a latch portion configured to detachably attach the application needle insertion material to a fixing member, wherein the application needle is inserted in an application material container and thus held, wherein the application needle insertion material is configured to allow an application needle case to be attached thereto to accommodate the application needle therein, and wherein the application needle is entirely covered by the application needle case and the application needle insertion material.

2. The application needle member according to claim 1, wherein the application needle insertion material includes a first attachment portion allowing the application needle insertion material to be detachably attached to the fixing member and a second attachment portion allowing the application needle case to be attached to the application needle insertion material.

3. The application needle member according to claim 1, wherein the application needle insertion material includes a first attachment portion and a second attachment portion, a surface of the first attachment portion having a color different from that of a surface of the second attachment portion, the first attachment portion being detachably attached to the fixing member.

4. The application needle member according to claim 1, wherein the application needle insertion material is attached directly to the second end of the application needle.

* * * * *